United States Patent [19]

Lum

[11] 4,359,291

[45] Nov. 16, 1982

[54] MULTICOLOR PEN

[76] Inventor: Victor Lum, 17 Pollard St., North Billerica, Mass. 02173

[21] Appl. No.: 113,299

[22] Filed: Jan. 18, 1980

Related U.S. Application Data

[63] Continuation of Ser. No. 813,442, Jul. 7, 1977, abandoned.

[51] Int. Cl.[3] ..... B43K 27/08

[52] U.S. Cl. ..... 401/33; 401/17; 401/202; 401/102

[58] Field of Search ..... 401/29–33, 401/196, 202, 17, 102

[56] References Cited

U.S. PATENT DOCUMENTS

| | | | |
|---|---|---|---|
| 2,176,124 | 10/1939 | Durrler | 401/33 |
| 2,451,111 | 10/1948 | Nichols | 401/31 |
| 2,561,824 | 7/1951 | Schmieglitz | 401/31 |
| 2,629,123 | 2/1953 | Mehmet | 401/202 |
| 2,668,516 | 2/1954 | Jovanovitsch | 401/17 |
| 2,703,070 | 3/1955 | Musser | 401/32 |
| 2,826,173 | 3/1958 | Gossweiler | 401/33 |
| 2,849,983 | 9/1958 | Gossweiler | 401/33 |
| 3,152,578 | 10/1964 | Hofmann | 401/33 |
| 3,205,866 | 9/1965 | Holl | 401/33 |
| 3,525,573 | 8/1970 | Fend | 401/196 |
| 3,592,552 | 7/1971 | Malm | 401/202 |

FOREIGN PATENT DOCUMENTS

| | | | |
|---|---|---|---|
| 822954 | 9/1969 | Canada | 401/31 |
| 467712 | 10/1928 | Fed. Rep. of Germany | 401/32 |
| 503319 | 7/1930 | Fed. Rep. of Germany | 401/33 |
| 2402334 | 8/1974 | Fed. Rep. of Germany | 401/33 |
| 2644958 | 4/1977 | Fed. Rep. of Germany | 401/31 |
| 1010739 | 3/1952 | France | 401/32 |
| 808421 | 7/1951 | German Democratic Rep. | 401/32 |
| 759949 | 12/1952 | German Democratic Rep. | 401/32 |
| 518042 | 3/1955 | Italy | 401/33 |
| 687000 | 2/1953 | United Kingdom | 401/31 |
| 778539 | 7/1957 | United Kingdom | 401/33 |

*Primary Examiner*—Clyde I. Coughenour
*Attorney, Agent, or Firm*—Schiller & Pandiscio

[57] ABSTRACT

A multi-element writing instrument is disclosed wherein the rotation of a selection portion located at one end of the instrument successively selects, advances and retracts individual writing elements. The writing point of each selected writing element is axially advanced through the exit opening without contact with the interior of the body of the instrument. In the writing position the axis of the selected element is aligned with the axis of the instrument. The novel construction permits the use of elements that employ different types of nibs, for example porous writing points, either alone or in combination with ball point-tipped elements.

18 Claims, 20 Drawing Figures

MULTICOLOR PEN

COPENDING APPLICATION

This application is a continuation application of U.S. Ser. No. 813,442 filed July 7, 1977, now abandoned.

The present invention relates in general to selectible multi-element devices, in particular to a novel writing instrument wherein any one of a plurality of writing elements may be individually selected.

Writing instruments which carry a plurality of writing points, e.g. of different colors, are well known. In some of these instruments, the respective writing elements, i.e. the refill cartridge and the associated writing point, are positioned side by side in individual channels. Each element has an appropriate tab or handle extending to the outside of the writing instrument and a selection is made by pushing the handle which corresponds to the desired writing element, in a downward direction toward the writing end of the instrument.

In many of these writing instruments, e.g. in pens, the exit opening through which the writing point is selectively extended outside the pen has a diameter slightly larger than that of the writing point itself. The hollow body of the pen normally tapers down at the writing end from its full diameter substantially to the diameter of the exit opening. The internal taper, whether planar or curved, provides a guide surface which is contacted by the writing point as it moves toward the exit opening. In the process, the writing element is deflected from its normal position parallel to the axis of the writing instrument so that the writing point emerges at an angle to the axis.

As a rule, instruments of this type provide sufficient slack or flexibility in the mounting of the writing element, or of the writing element itself, so that the aforesaid deflection of the element can be accommodated. However, a salient disadvantage of such writing instruments is their inability to use porous writing points, such as felt tips, because force with which the writing point bears against the tapered interior surface of the pen is often sufficient to damage the felt tip. Further, the writing fluid which tends to be deposited on the tapered interior surface of the pen body, will cake in time and block the exit opening, produce color contamination, as well as spread to the outside surface of the pen. A major limitation resides in the difficulty of sealing such writing instruments (when not in use) to avoid evaporation of the solvent from the porous writing tip.

Another disadvantage of such writing instruments is the relatively large outside diameter which is required to accommodate a plurality of writing elements so arranged. Often this is due to the size of the cartridge selection mechanism and the inability to reduce the size of the cartridges, particularly porous nib cartridges. The writing instrument thus becomes unwieldy and tends to cramp the style of the writer. A further disadvantage is the slanted position of the writing point as it emerges from the exit opening, as discussed above, which also tends to interfere with the use of the pen. Further, for certain types of applications where accuracy of line is important, for example in certain types of plotting, the displacement of the writing point from a true axial position renders the writing instrument unsuitable for the purpose.

Attempts to overcome and eliminate these disadvantages of multi-element writing instruments have met only with partial success. For example, arrangements exist as shown in U.S. Pat. No. 3,586,451, wherein the individual writing elements are positioned in a turret arrangement which may be rotated from the selection end of the pen opposite the writing end. Upon rotation, all writing elements pass through a position that is aligned with the exit opening of the writing instrument. As each writing element reaches this position, it may be selectively moved downward until the writing point emerges from the exit opening.

While the device described successfully overcomes certain problems of prior art multi-element writing instruments, it introduces disadvantages of its own which render it unsuitable or undesirable for many applications. The turret arrangement necessitates an instrument which has a relatively large diameter, thus giving rise to the problems discussed above. A further problem arises from the necessity of placing the exit opening along a line which, although parallel to the approximate central axis of the writing instrument, is spaced therefrom. This type of configuration limits the utility of such a writing instrument, occasionally obscuring a portion of the line under the pen unless the writing point extends an unduly large distance out from the exit opening. Further disadvantages inhere in the necessity of performing two operations in the selection of a writing point, i.e., rotating the turret and subsequently depressing the selected writing element downward.

It is a primary object of the present invention to provide a multi-element device which is not subject to the foregoing disadvantages.

It is another object of the present invention to provide a substantially symmetrical multi-element writing instrument having a relatively slim configuration, which is convenient to hold and to handle.

It is still another object of the present invention to provide a substantially cylindrical multi-element writing instrument wherein the selected writing point is aligned with the axis of the instrument.

These and other objects of the present invention, together with the features and advantages thereof, will become apparent from the following detailed specification when read in conjunction with the accompanying drawings in which like reference numerals refer to identical parts.

Figure 1:
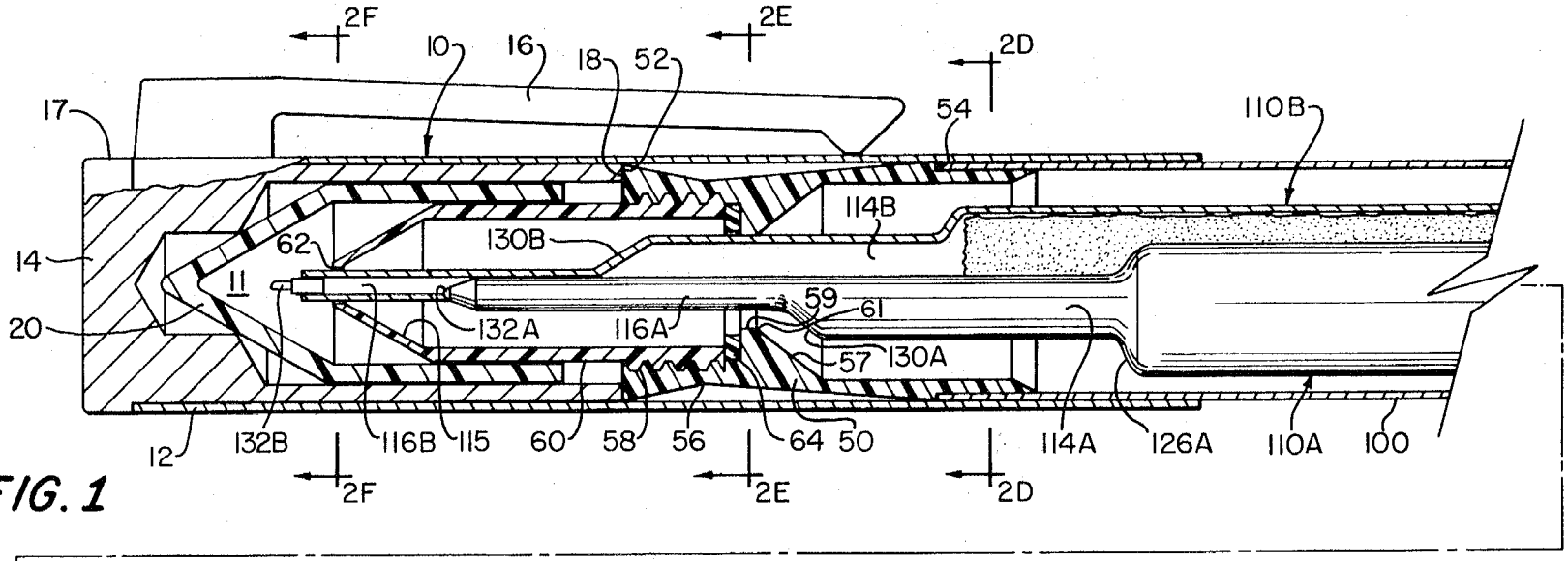
FIG. 1 illustrates in partial cross-section a preferred embodiment of the present invention.
Figure 1A:
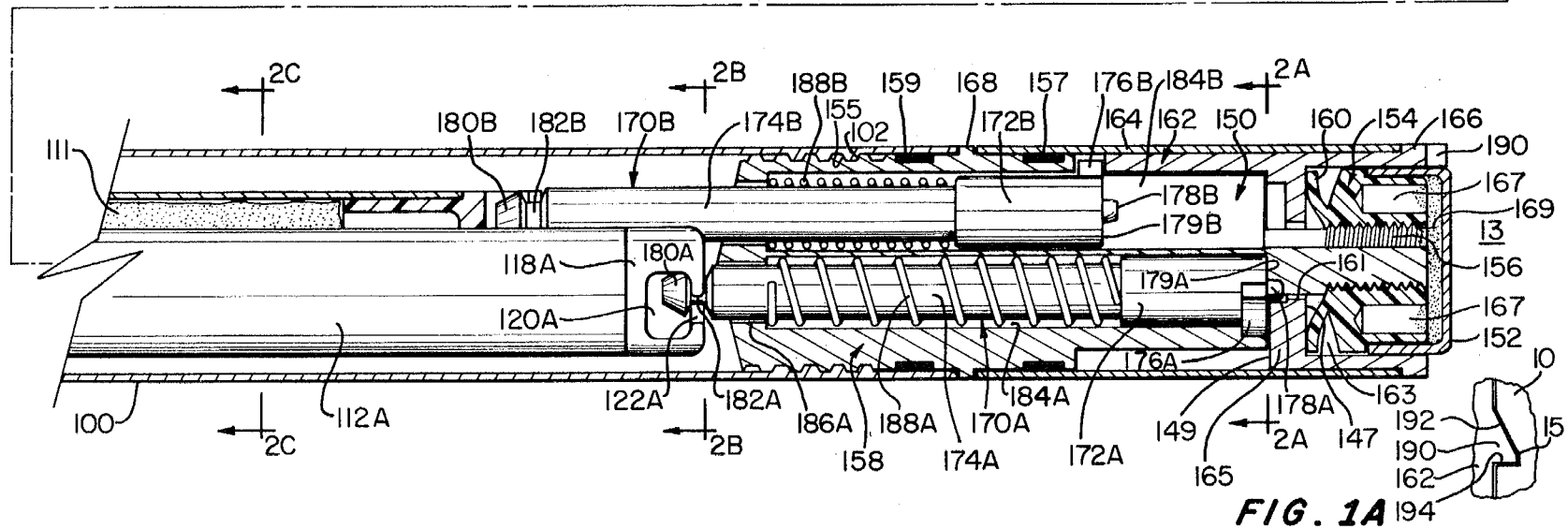
FIG. 1A is a detail view of a portion of the apparatus of FIG. 1.
Figure 5:
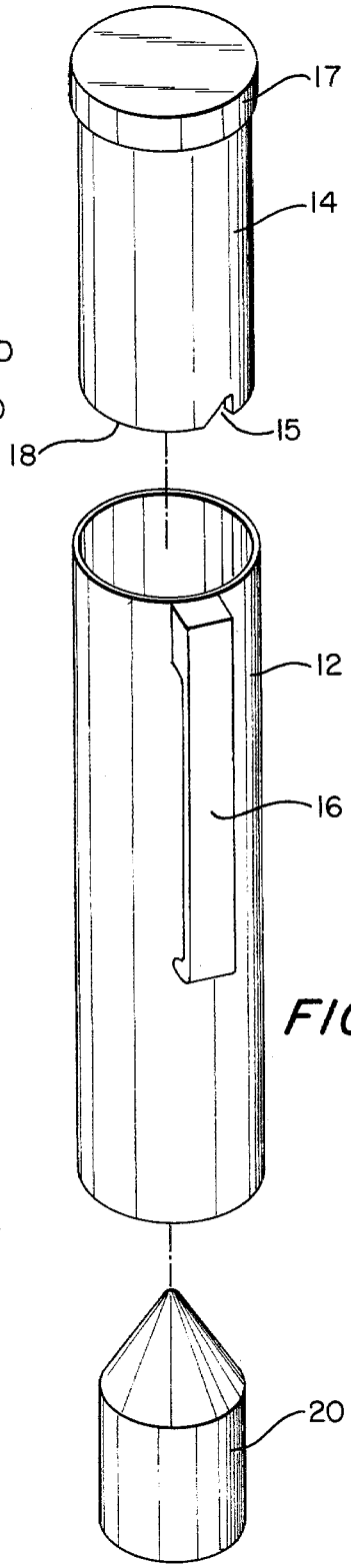
FIG. 5 is an exploded view of the pen cap assembly of the apparatus of FIG. 1.

With reference now to the drawings, FIG. 1 illustrates a preferred embodiment of the invention in the form of a substantially cylindrical multi-element pen. The writing end of the pen, generally designated by the reference numeral 11, is encased by a removable pen cap 10. The pen cap, which is further illustrated in FIG. 5, comprises a hollow substantially cylindrical body 12 which has a pen cap top 14 secured therein closing off one end of the cap body. Cap top 14 includes a shoulder 17 which preferably has an outside diameter equal to that of cap body 12 to provide a continuous outside pen cap surface. The lower edge 18 of cap top 14 includes a notch 15 which is shown in greater detail in FIG. 1A. A cap clip 16 is secured to parts 12 and 14 and allows the pen to be clipped onto a garment or the like for carrying purposes.

Figure 3:
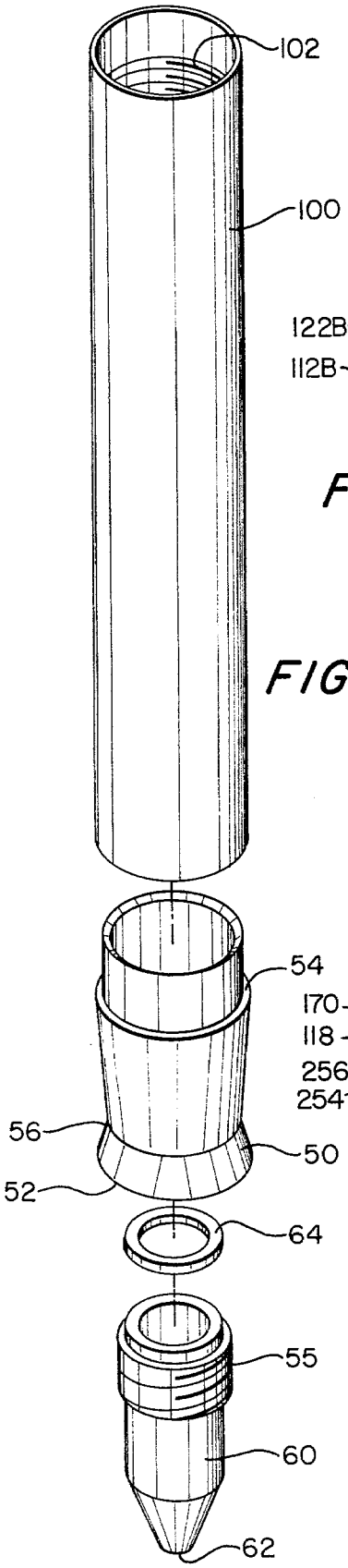
FIG. 3 illustrates in exploded form the pen body assembly of the apparatus of FIG. 1.

When pen cap 10 is disposed on the writing end of the pen as shown, pen cap body 12 frictionally engages the outside of main pen shank 100. Further, lower edge 18 of cap top 14 abuts an external shoulder 52 of lower pen shank 50 in a plane normal to the pen axis. As shown particularly in FIG. 3, shank 100 preferably consists of a hollow cylindrical body coaxial with the axis of the pen and includes a lower edge which abuts another external shoulder 54 of lower pen shank 50. Parts 50 and 100 are adhesively secured together and jointly present a substantially continuous outside surface of the pen.

Lower pen shank 50 includes an external waist 56 of reduced outside diameter for ease of gripping. Pen shank 50 further comprises a sloped internal shoulder 57 which facilitates the assembly of the respective pen components. Shoulder 57 narrows down to a throat section or exit template 59 of reduced diameter, as further shown in FIG. 2E. The junction between throat section 59 and shoulder 57 is designated by the reference numeral 61, as shown in FIG. 1. An internal thread 58 of lower shank 50 engages an external thread 55 of a point shroud 60. Shroud 60 tapers down to an exit opening 62 which permits the writing point of a writing element within to extend outside. A cap seal 20 is secured within cap top 14 and engages shroud 60 when pen cap 10 is in place on the writing end of the pen. The sealing action provided by the pen cap inhibits drying out, by way of exit opening 62, of the writing fluid carried by the writing point 132 and its associated cartridge 110, particularly where a porous point nib, such as a felt tip, is used. Further sealing is provided by a shroud seal 64 in the form of a gasket which is disposed between shroud 60 and lower pen shank 50 to inhibit leakage of air between the latter.

The upper end of main pen shank 100 includes an internal thread 102 which engages a corresponding thread 155 of a selection assembly generally designated by the reference numeral 150. As will become apparent from the discussion below, the sense of threads 102 and 155 is important with respect to the rotation of unit 150 relative to main pen shank 100. The upper end of assembly 150 forms the selection end of the pen and is generally designated by the reference numeral 13. Assembly 150, shown in both FIG. 1 and the exploded view of FIG. 4, includes a pin retaining barrel unit 158 and a cam and detent unit 162 coaxial therewith. Both units have a generally cylindrical form, unit 158 including an upper segment of reduced diameter.

The cylindrical form provided by unit 162 is generally open at one end and includes divider wall 165 at its other end. Divider wall 165 has top and bottom surfaces 147 and 149 respectively and includes a central bore 161. The open ended cylindrical form of unit 162 defines a cylindrical recess 163 above surface 147 in which a torque nut 154 is disposed. The resilient lip 160 of the nut functions as a seal to prevent air from entering the pen through bore 161. Further sealing is provided by a pair of ring-form seals 157 and 159 disposed as shown in FIG. 1. The torque nut may consist of different types of material, such as an elastomer, or polymer, or the like and includes an internal threaded bore 241 which engages the threaded end of a shank 156 of pen retaining barrel unit 158. Shank 156 extends from the aforesaid segment of reduced diameter of unit 158 and defines shoulder surfaces 240 therewith. Shank 156 is integral with pin retaining barrel unit 158 and extends through bore 161 into recess 163 of cam and detent unit 162. Thus, the respective parts of the selections assembly 150 are locked together when the torque nut engages shank 156. The amount by which the torque nut is screwed down on shank 156 determines the amount by which the resilient lip 160 is flattened out of its natural convex shape. The force thus exerted by the torque nut may be adjusted by suitably advancing or backing off the torque nut 154 on shank 156. Torque nut 154 further includes a pair of bores 167 or equivalent depressions adapted to accept a spanner wrench or other tool for rotating the nut. The torque nut is peripherally recessed to accept a cup-shaped top cap 152 which may be secured to the torque nut by a pliable layer 169 (shown in FIG. 1) of cement or the like. The pliable cement layer additionally performs a sealing function by blocking the passage of air through threaded bore 241 of torque nut 154. In an alternative construction, bore 241 can be fashioned as a blind bore, in which case it will not pierce the top surface of the torque nut. An external sleeve 164 is positioned between shoulder 166 of unit 162 and a shoulder 168 of unit 158 so as to present a substantially uniform external surface.

Figure 2A:
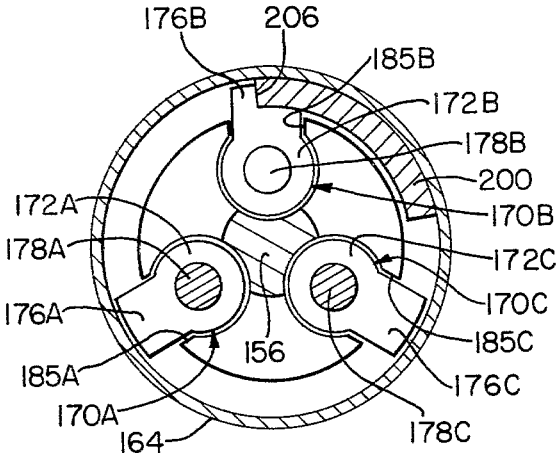
FIGS. 2A–2F illustrates a series of views taken at various designated cross-sections of the apparatus of FIG. 1.
Figure 4:
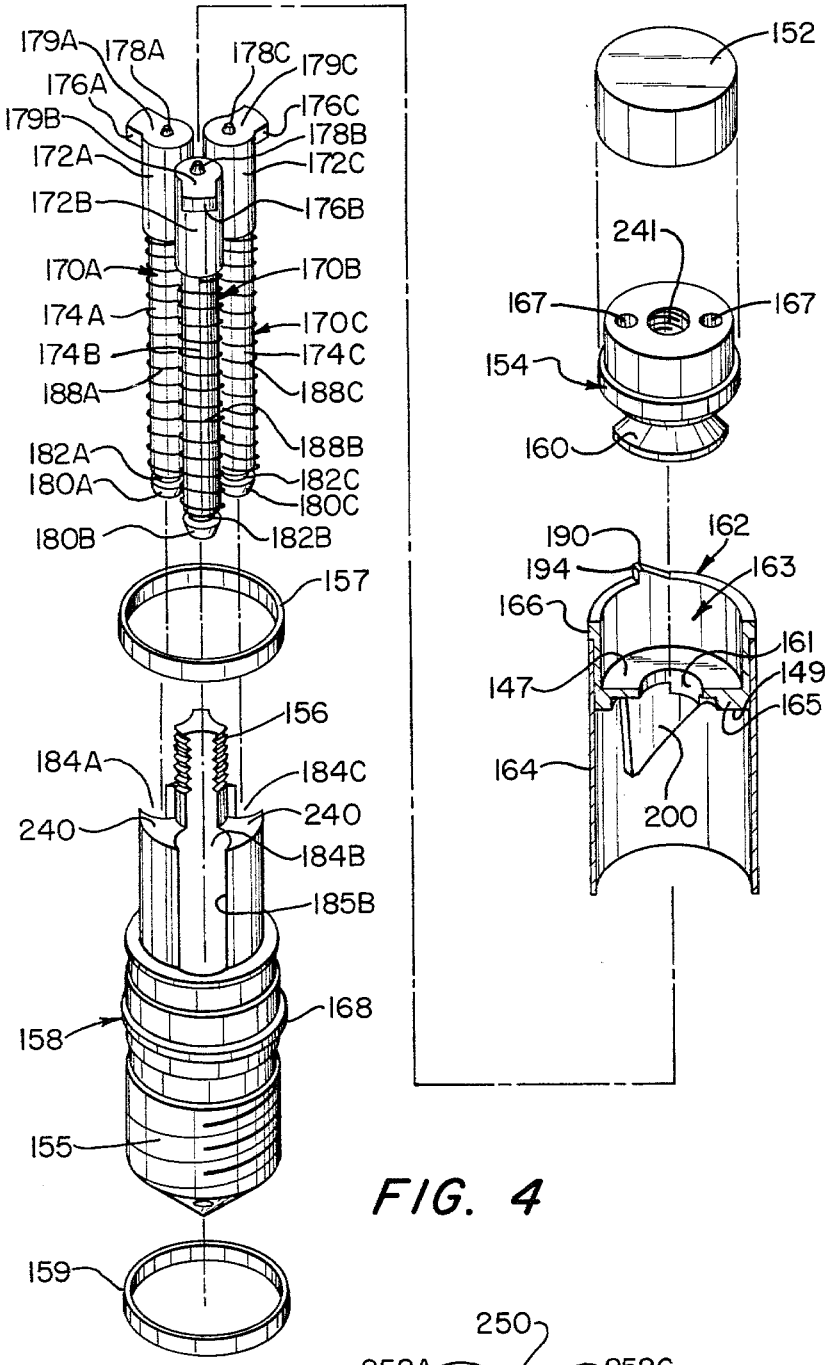
FIG. 4 is an exploded view of the pin selection assembly of the apparatus of FIG. 1.

In the preferred embodiment of the invention shown, three separate writing elements are used. Accordingly, shank 156 of pin retaining barrel unit 158 has a substantially triangular cross-section wherein the sides of the triangle are concave to accommodate refill retaining pins 170A, 170B and 170C respectively, as best shown in FIGS. 2A and 4. It should be noted that the invention is not limited to the three writing elements shown and that fewer or more elements can be employed. For the foregoing reason letter designations are used herein only when required to distinguish between different ones of otherwise substantially identical parts. In all other situations the number designation alone is used.

Each retaining pin 170 comprises a shaft 174 and a cylindrical head 172 of a diameter greater than that of shaft 174. Head 172 includes an integral cam follower 176 in the form of a tang that extends at right angles to the axis of the retaining pin. The bearing surface of the cam follower, i.e., the surface adapted to contact the cam 200 of the cam and detent unit 162 (described hereinafter), is flush with upper surface 179 of head 172. The latter further includes a nipple 178, tapered at least in part, which extends in an axial direction from upper surface 179.

Each pin 170 terminates in a hanger button 180 opposite head 172, connected to pin shaft 174 by a narrow neck section 182. Button 180 has substantially the form of a truncated cone which has a diameter at its widest point equal to that of shaft 174.

Each retaining pin rides in a bore 184 of pin retaining barrel unit 158 which is formed in part by the aforesaid concave side of the triangular cross-section of shank 156. See FIG. 4. The diameter of bore 184 is such as to accept pin head 172 in a sliding fit. A constricted section 186 (shown in FIG. 1) at the bottom end of bore 184 accepts only the diameter of pin shaft 174. Each bore 184 includes a slot 185 parallel to the bore axis and coextensive in length with the aforesaid segment of reduced diameter of the pin retaining barrel unit 158. When the retaining pins are positioned in bores 184, each cam follower 176 extends out of the bore through slot 185. As shown in FIG. 1, the length of the slot permits the corresponding retaining pin 170 to move between its retracted position illustrated by pin 170A, and its extended position as illustrated by pin 170B.

A compression spring 188 surrounds each pin shaft 174 and is axially retained in position by a pair of shoulders formed respectively by head 172 of the corresponding pin 170 and by constricted bore portion 186 the respective bore 184 of pin retaining barrel unit 158. The spring normally urges retaining pin 170 to its retracted position, as shown at 188A in FIG. 1. When the pin is in the extended position, the spring is compressed between the aforesaid shoulders, as shown at 188B in FIG. 1.

FIG. 4 shows generally, while FIGS. 6–9 show in greater detail, certain features of cam and detent unit 162. A tooth 190 extends axially upward from top surface 139 of shoulder 166. Tooth 190 includes an edge surface 192 which is ramped with respect to surface 139, as well as an edge surface 194 which is normal to surface 139. An edge surface portion 198 is positioned between surfaces 192 and 194 and is substantially parallel to surface 139. Tooth 190 may have any desired circumferential position on top surface 139.

Figure 7:
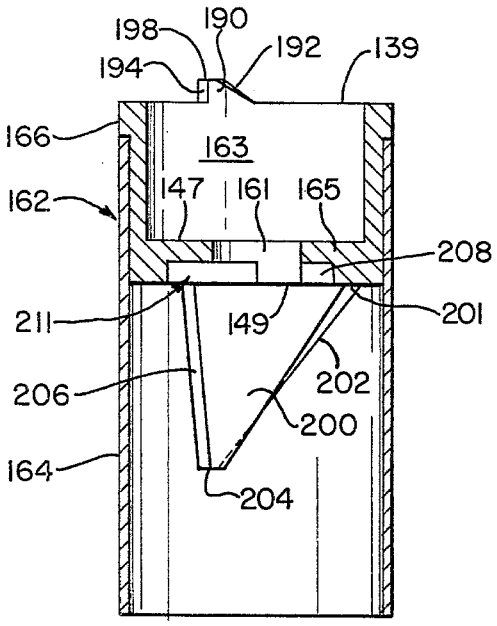
FIG. 7 is a cross-sectional elevation view of the apparatus of FIG. 6.
Figure 6:
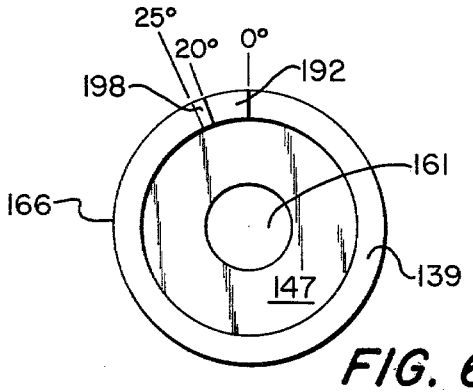
FIG. 6 is a top view of the cam and detent unit of the apparatus of FIG. 1.
Figure 9:
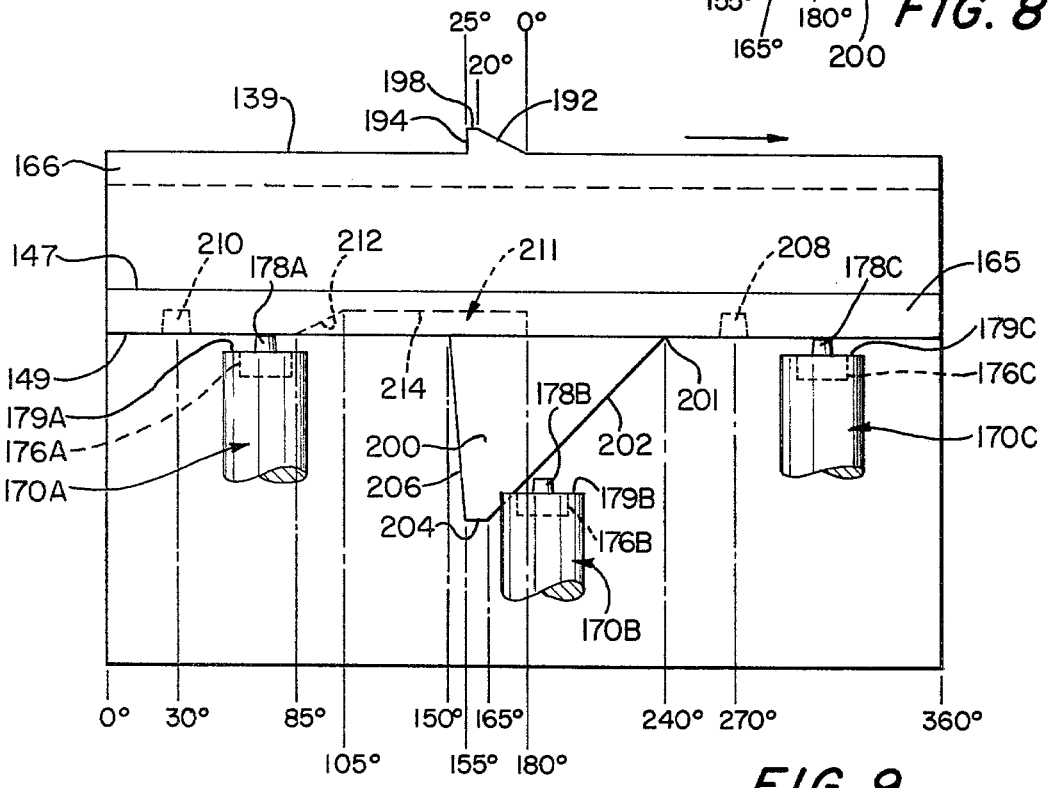
FIG. 9 is a developed view of the apparatus of FIG. 7.

It will be noted that some of the surfaces shown in FIG. 7 appear as a pair of lines which intersect at a small angle, e.g. the lines depicting surfaces 192 and 202 respectively. This is brought about by the planar projection in FIG. 7 of what are essentially curved edge surfaces. For greater clarity, FIG. 9 illustrates the unit of FIG. 7 in a rolled-out fashion and it will be noted that surfaces 192 and 202, each appear as a single line there.

Tooth 190 is dimensioned to mate with notch 15 which is disposed in lower edge 18 of pen cap top 14 when pen cap 10 is positioned on selection end 13 of the pen. See FIG. 1A. In the latter position, pen cap 10 frictionally engages sleeve 164. When pen cap 10 is then rotated in a clockwise direction, the appropriate surface of slot 15 bears against tooth surface 194 and rotates unit 162 in the same direction. As will become clear from the explanation below, unit 162 cannot rotate in the counter-clockwise direction relative to the main body of the pen. Therefore, when pen cap 10 is rotated in the counter-clockwise direction, it ramps up on surface 192 and notch 15 disengages from tooth 190.

Unit 162 further comprises a cam 200 which coaxially surrounds a portion of the aforesaid reduced diameter segment of pin retaining barrel unit 158. The edge of cam 200 forms a surface consisting of a sloped lift surface portion 202, a level dwell surface portion 204 and a substantially vertical return surface portion 206. In practice, it is preferable to provide portion 206 with a small angle, e.g. 5° from the vertical, for reasons that will become apparent hereinbelow. Pins 170 are positioned so that during each complete revolution of cam and detent unit 162, the cam 200 successively engages each cam follower 176 of the corresponding pin. A pair of detent holes 208 and 210 is disposed in lower surface 149 of divider wall 165, adjacent the periphery of central bore 161. Each detent hole has a side wall with a slight outward taper and a diameter adapted to admit nipple 178 while excluding head 172 of retaining pin 170. The depth of the detent holes exceeds the length of nipples 178.

Divider wall surface 149 further includes a sector recess 211 adjacent the periphery of central bore 161, which extends through a 95° angle in the illustrated embodiment of the invention. As best seen from FIG. 9, sector recess 211 includes a ram surface 212 positioned between divider wall surface 149 and a level bottom surface 214. As shown, bottom surface 214 extends through a 75° angle and straddles the substantially vertical return surface portion 206. The depth of recess 211, i.e. the distance between surfaces 214 and 149, is substantially the same as the depth of detent holes 208 and 210. As such, it is greater than the length of nipples 178 of pins 170. Likewise the radial width of the sector recess, (best seen in FIG. 8), is smaller than the diameter of pin head 172, but wide enough to admit nipple 178.

Figure 8:
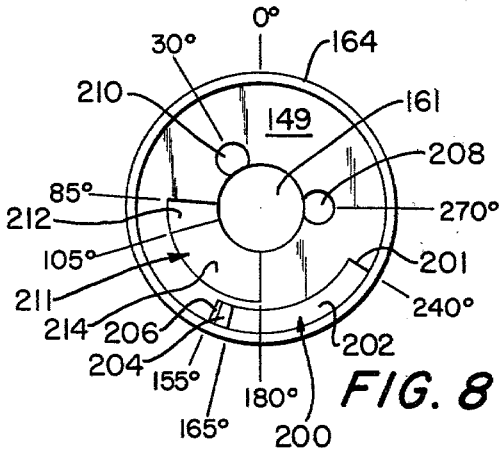
FIG. 8 is a bottom view of the apparatus of FIG. 7.

Cam and detent unit 162 is capable of rotating in the clockwise direction, which is seen as a counter-clockwise rotation in the bottom view of FIG. 8. Thus, the relative angular positions of the various components of unit 162 take on significance as they are encountered in the counter-clockwise direction in FIG. 8. As shown in both FIGS. 8 and 9, the center of detent hole 210 is centered at 30° from the 0° position. The end of ramp surface 212 is at 85° and its beginning point, (at the bottom of recess 211), is at 105°. Return surface portion 206, which is substantially vertical, is located between 150° and 155°, while sloped portion 202 of the camming surface reaches its full height at 165°. Level dwell surface portion 204 extends for 10° between these two locations. Recess 211 starts at 180° and lift surface portion 202 has its low point 201 at 240°. Detent hole 208 is centered at 270°.

In the preferred embodiment of the invention illustrated in FIG. 1, main pen shank 100 contains three writing elements in the form of refill cartridges 110A, 110B and 110C respectively. As best seen from FIGS. 10A and 10B, each refill cartridge has an upper section 112, a mid-section 114 and a lower section 116 respectively. Upper section 112 preferably has a substantially sector-shaped cross section (as for example shown in FIG. 2C) which approximates a 120° angle in the 3-cartridge arrangement shown. Midsection 114 has a modified elliptical cross section with parallel sides (shown in cross-section in FIG. 2D), while the cross section of lower section 116 is circular (see for example FIG. 2E). The respective sections are positioned with respect to each other to form a common cartridge axis 121 and a common, linear cartridge spine 119 parallel to axis 121. The sector-shaped sections 112 are adapted to nest symmetrically about the common axis of the pen, either in close proximity or in contact with each other, when all cartridges disposed within main pen shank 100 have the same axial position. In that position, spines 119 face inwardly and axes 121 are radially displaced from the axis of the pen by equal amounts.

Figure 10A:
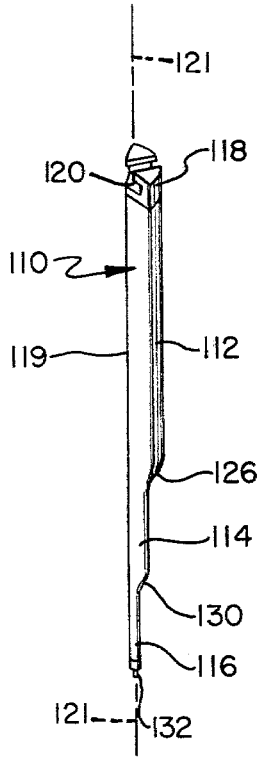
FIG. 10A is an elevation view of a preferred refill cartridge for use in the apparatus of FIG. 1.

Upper cartridge section 112 is closed off by a cartridge cap 118 which presents a substantially C-shaped configuration when viewed from the side. As shown in FIGS. 1 and 10A, the arms of the C-shaped configuration of cap 118 define a space 120 which is adapted to accept hanger button 180 of retaining pin 170. The confronting end surfaces of the arms have a mutual spacing 122 between them wide enough to receive neck section 182 of pin 170. Spacing 122 is, however, smaller than hanger button 180 which must be inserted from the side.

When assembled, the three refill cartridges are supported on the hanger buttons of the respective pins 170 in a manner which permits each pin to pivot about its corresponding button 180 as well as to move in a lateral direction perpendicular to the common axis of the pen. Since the respective cartridges are suspended with sections 112 in close proximity or in contact with each other, such lateral motion by one cartridge, e.g. 112B in FIG. 2C, establishes positive contact and results in the lateral displacement of the other cartridges, as shown at 112A and 112C.

For felt-tipped writing elements or the like, upper section 112 of each cartridge 110 contains an impregnated refill sponge, as shown at 111 in FIG. 1. For ball point writing elements, upper section 112 constitutes an ink reservoir. In both cases, writing fluid from section 112 is dispensed to writing point 132 of the cartridge through sections 114 and 116. In the case of felt-tipped cartridges a wick 128 (see for example FIG. 2D) serves as the conduit. The use of cartridges having a relatively large ink holding capacity is permitted in the present invention by the compactness of selection assembly 150 and by the absence of any supporting structure between the cartridges, such as the turret structure used in certain prior art devices.

Figure 10B:
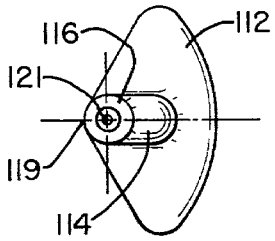
FIG. 10B is an enlarged bottom view of the apparatus of FIG. 10A.

As best seen in FIGS. 10A and 10B, the transition between upper section 112 and midsection 114 consists of a shoulder 126. The transition between midsection 114 and lower section 116 comprises a ramp surface 130. Lower cartridge section 116 terminates in writing point 132. The maximum cross-sectional dimension of midsection 114 is twice the diameter of the circular cross-section of section 116, while its minimum dimension is equal to that diameter.

When pen cap 10 is in the position shown in FIG. 1, the respective writing points are sealed against drying out by the action of resilient lip 160 of torque nut 154 and pliable cement layer 169 which seal bore 161 of the cam and detent unit 162; by O-rings 157, 159 and 64; and by cap seal 20 which seals writing end 11 of the pen. Cap seal 20 is spaced sufficiently far from exit opening 62 of point shroud 60 so that it is clear of any writing point that may extend through the opening.

For writing purposes cap 10 is removed from writing end 11 of the pen and is normally placed on selection end 13, where it is in frictional contact with sleeve 164. The selection of the desired writing point occurs by rotating cap 10 in a clockwise direction relative to main pen shank 100. As previously explained, the bottom edge of cap top 14 contains a notch 15 adapted to mate with tooth 190 which extends upward from shoulder 166 of cam and detent unit 162. See FIG. 1A. When cap 10 is rotated in a clockwise direction around the pen axis, the vertical surface of notch 15 bears against surface 194 of tooth 190 to cause unit 162 to rotate with it in the same direction. The sense of mating threads 102 and 155 is such that clockwise rotation of unit 162 tightens them on each other. Cam 200, which is an integral part of unit 162, then likewise rotates in a clockwise direction around the common axis of the pen, leading with low point 201 of its sloped lift surface portion 202 (See FIGS. 8 and 9).

FIG. 9 further illustrates the relationship of retaining pins 170 to the respective parts of unit 162. For the sake of illustrating the operation of the invention, FIG. 9 shows pins 170 at a point slightly in advance of the position shown by FIG. 1, the latter Figure showing unit 162 at one of the selection stations.

Normally the retaining pins 170 are urged against lower surface 149 of divider wall 165 by the action of the corresponding springs 188. As shown in FIG. 9 for pins 170C and 170A, the spring action causes nipples 178C and 178A to ride on surface 149. During this interval, cam follower 176B of pin 170B rides up the sloped cam surface portion 202.

As unit 162 rotates further in the clockwise direction relative to pins 170, (i.e., movement in the direction of the arrow in FIG. 9), the cam follower 176B reaches dwell surface portion 204 and detent holes 208 and 210 move directly under nipples 178C and 178A respectively. The action of springs 188C and 188A then causes pins 170C and 170A respectively to detent, i.e. to enter their confronting detent holes. As shown in the drawings, the diameter of each detent hole is large enough to accept nipple 178 while excluding pin head 172. Since the nipple is shorter than the depth of the detent hole, the upper surface 179 of each head 172 then bears against surface 149.

The detenting action occurs during the dwell of cam follower 176B on level dwell surface portion 204. Because the torque necessary to dislodge the nipples from the detent holes is greater than that required to merely turn unit 162 when the nipples ride on top of surface 149, the detenting action establishes a positive angular position for unit 162 which lends stability to the position of cam follower 176B on surface portion 204. When this condition prevails, unit 162 may be regarded as being positioned at a selection station, at which cartridge 110B is "selected" by being displaced axially downward by pin 170B as shown in FIG. 1. In the illustrated embodiment of the invention, unit 162 traverses three selection stations in one complete revolution.

The importance of the detenting action will become clear when it is considered that a force is applied to the writing point 132 of the "selected" cartridge when writing takes place, particularly when a ball point writing nib is used. This force, if not applied in a precise axial direction, can act to destabilize the position of cam follower 176 on cam surface portion 204 and cause the selected cartridge to retract during writing. The detenting action described above guards against such an event and assures the stability of the selected writing element while simultaneously retaining the non-selected elements in position.

As previously explained, the amount of torque required to turn cam and detent unit 162 in a clockwise direction relative to pen body 100 is determined by the position of torque nut 154 on the threaded end of shank 156 of pin retaining barrel unit. The further the torque nut is advanced on the shank against the action of resilient lip 160 which bears against surface 147 of divider wall 165 of cam and detent unit 162, the greater is the force with which surface 149 of divider wall 165 bears against surfaces 240 (See FIG. 4) of the pin retaining barrel unit 158. Thus, the torque required for the selection of respective elements may be adjusted.

As shown in FIG. 9, cam follower 176B rides successively on surface portions 202 and 204 while cam and detent unit 162 rotates. The slot 185B formed in shank 156 of pin retaining barrel unit 158 (shown in FIG. 4) serves as a guide for cam follower 176B of cartridge 170B. When unit 162 is turned beyond the selection station, cam follower 176B is dislodged from level dwell surface portion 204. Pin 170B is driven toward surface 149 by spring 188B as cam follower 176B rides up surface 206 in contact therewith. As previously explained surface 206 preferably has a small angle of about 5° from the vertical. The purpose of the angled surface is to establish sufficient friction with cam follower 176B so as to reduce the velocity of impact of pin 170B on surface 149 of divider wall 165. As noted above recess 211 straddles the angular position of surface 206 and is only wide enough to accept nipple 178 of the retaining pin, but not the width of pin head 172. Further, the depth of recess 211 is greater than the length of the nipple. Accordingly, as pin 170B drives against surface 149, upper pin head surface 179B will strike surface 149 on both sides of recess 211, while nipple 178B enters the recess without taking any impact.

Referring to FIG. 9, upon further clockwise rotation of cam and detent unit 162, cam follower 176C of the subsequent retaining pin, i.e. pin 170C, reaches point 201 and begins its climb up the sloped camming surface portion 202. Surface 179B of pin head 172B remains in contact with surface 149 on opposite sides of recess 211 until ramp surface 212 is reached at the 105° position. Further clockwise rotation of unit 162 brings nipple 178B into contact with ramp surface 212 as the depth of recess 211 decreases under the nipple and lifts pin head surface 179B off surface 149.

Further clockwise rotation causes nipple 178B to exit from recess 211 and ride on surface 149 until it drops into detent hole 210. At that point, the cam follower 176C has completed its rise and is positioned on level dwell surface portion 204. Further, nipple 178A of retaining pin 170A is then lodged in detent hole 208.

From the foregoing explaination, it will be apparent that a full 360° rotation of unit 162 relative to main pen shank 100 will successively cause all three pins 170 to be displaced downwardly so that each extends from pin retaining barrel unit 158, as shown in FIG. 1 for pin 170B. Accordingly, the corresponding writing points 132 will be successively selected and caused to extend through exit opening 62.

Whenever a retaining pin extends from unit 158, it thrusts against cartridge cap 118 of the corresponding "selected" refill cartridge 110 in a direction parallel to the common pen axis but radially spaced therefrom and seeks to displace the cartridge in the same downward direction. As ramp surface 130 of the selected cartridge bears against junction 61 between shoulder 57 and throat section 59 of the lower pen shank 50, the selected cartridge is displaced in a lateral direction toward the center of the pen while continuing its downward travel toward opening 62. As previously explained, lateral cartridge motion is permitted by the linkage provided by the C-shaped cartridge cap 118 and hanger button 180. During this action ramp surface 130, which has a slope relative to the common pen axis somewhat smaller than that of shoulder 57, remains substantially out of contact with the latter.

Figure 2B:
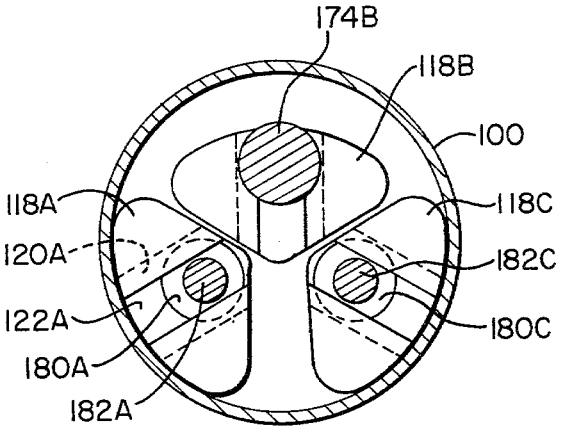
Figure 2C:
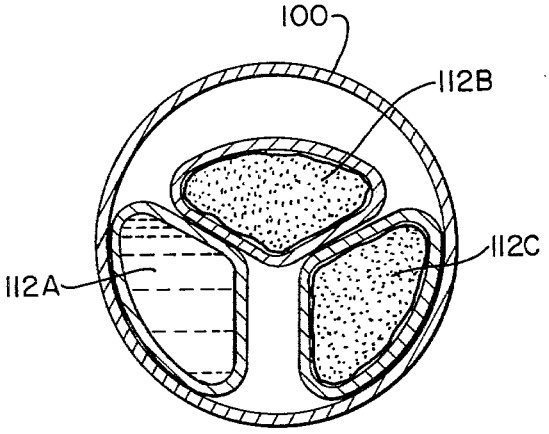

FIG. 2C shows the cross-sections of upper cartridge sections 112. As shown, the lateral displacement of section 112 toward the common pen axis causes sections 112A and 112C to be displaced away from the axis. As shown in FIG. 1, the ramping action continues until ramp surface 130 has cleared junction 61. Thereafter, further axial movement of the selected cartridge is stabilized by contact between mid-section 114 and throat section 59 of the lower pen shank 50 as shown in FIG. 2E. Thus, the off-center thrust of retaining pins 170 is converted into axially aligned displacement of the selected cartridge. The presence of lower sections 116 of the two nonselected cartridges in throat section 59 precludes further radial movement and serves to hold the midsection of the selected cartridge in position in the throat section.

As illustrated in FIGS. 1 and 2E it will be seen that spine 119B of the selected cartridge 110B is now displaced from the common axis of the pen by an amount which brings cartridge axis 121B in line with the pen axis. Since exit opening 62 of lower pen shank 50 is coaxially disposed on the pen axis, the aforesaid lateral displacement, together with the appropriate axial length of shroud 60, assures that writing point 132B of cartridge 110B will pass through opening 62 substantially out of contact with the tapered inner surface 115 of the shroud.

The relative positions of the writing elements and other parts will be understood with reference to the respective cross-sectional views of FIGS. 2A–2F. FIG. 2A is a view taken at cross section A—A in FIG. 1 and shows retaining pins 170A and 170C in their retracted positions while pin 170B is extended. Cam follower 176B is poised on the level dwell surface portion of the cam, straddling the edge of cam surface portion 206, as shown. Cam 200 is in partially overlapping position with respect to slot 185B, as indicated by the position of surface 206 adjacent the slot.

FIG. 2B illustrates the relative positions of the parts at cross section B—B in FIG. 1. Two cartridge caps 118A and 118C and a pin shaft 174B are shown. It will be noted that the cartridges are not symmetrically positioned around the axis of the pen. Cartridge 118B has moved radially toward the common pen axis, while cartridges 118A and 118C are in their original radial positions.

FIG. 2C, taken at cross section C—C in FIG. 1, provides a view of the upper cartridge sections 112 as well as of the relative lateral displacement of the respective cartridges. Writing element 110A has a ball point writing nib and hence section 112A is an ink reservoir. Cartridges 110B and 110C have felt tip nibs and their upper sections 112A and 112B each contain an impregnated sponge.

Figure 2D:
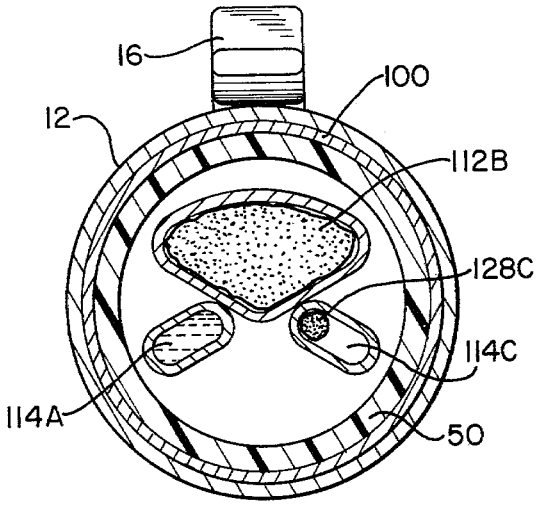
Figure 2E:
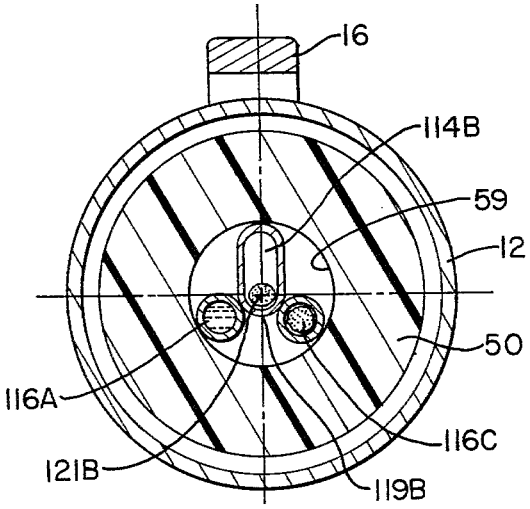

FIG. 2D, taken at cross section D—D in FIG. 1, shows midsections 114A and 114C in contact with upper section 112B of the selected cartridge. The latter, i.e. cartridge 110B, is therefore laterally as well as axially displaced. Section 114A contains ink for the ball point nib, while a wick 128C serves as a conduit between the impregnated sponge and the felt tip nib of writing element 110C.

FIG. 2E, taken at cross section E—E in FIG. 1, illustrates throat section 59 and the relative positions of lower cartridge sections 116A and 116C which hold midsection 114B of the selected cartridge in place. Sections 114B and 116C both contain a wick which connects between the impregnated sponge and the felt tip nib of each of these cartridges. Section 116A contains only ink.

Figure 2F:
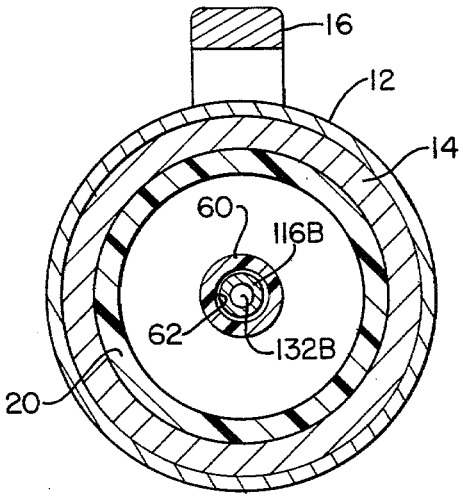

FIG. 2F, taken at cross section F—F in FIG. 1, illustrates the alignment of writing point 132B with the axis of the pen. It will be seen that the writing point remains clear of the internal surface of shroud 60.

When it is desired to change the refill cartridges, unit 162 is rotated in the counter-clockwise direction relative to main pen shank 100. This action causes the entire selection assembly 150 to be unscrewed from threads 102 in the upper portion of main pen shank 100. Assembly 150 can then be axially withdrawn from the main pen shank, carrying with it the three writing elements, i.e. refill cartridges 110. Whatever cartridges are to be replaced are then lifted off hanger buttons 180 and fresh cartridges are substituted. Upon replacement, spines 119 of all the cartridges must face inward to permit the cartridges to nest against each other to fit them into the main pen shank when the latter is reassembled with assembly 150.

From the foregoing discussion, it will be apparent that a novel writing instrument has been provided which contains a plurality of elongate writing elements that may be individually selected, advanced and retracted solely by rotation of the selection end of the writing instrument. The required turning torque of the selection mechanism is adjustable in accordance with the action desired. A detenting action is provided which defines the respective selection stations and which maintains the writing element selected at each station, as well as the non-selected elements, in their respective positions.

The writing instrument which forms the subject matter of the present invention has a relatively slim, symmetrical configuration to assist in writing. Each selected writing element extends from the exit opening in alignment with the axis of the instrument and contact between the writing point and the interior surface of the instrument is avoided. The latter feature makes the use of felt tip writing points feasible, whether used exclusively or in combination with ball point nibs. Appropriate sealing prevents drying out of the writing points. Disassembly of the instrument, e.g. to replace the cartridges, is readily carried out by rotation of the selection end in a direction opposite to that used to select a writing element. Accordingly, the selection mechanism cannot be jammed by inadvertent rotation in the wrong direction.

It will be noted that the construction of the present invention is such as to prevent damage to selection assembly 150, even if the pen is mishandled. Thus, the maximum torque that can be applied by clockwise rotation of the selection unit relative to main pen shank 100 during assembly of the pen, or pursuant to the selection of individual elements, is determined by the pre-set position of torque nut 154. On the other hand, counter-clockwise rotation of the selection unit causes threads 102 and 155 to disengage and thus prevents any damage from occurring.

The selection assembly used in the present invention is simple and requires only few parts. Therefore, the cost of manufacture of the writing instrument is low and it is less prone to mechanical failure than comparable writing instruments of the prior art. In accordance with the novel arrangement disclosed, the thrust of the selection pins in a direction parallel to the axis of the instrument, but radially displaced therefrom, is converted into a downward displacement of the writing point into a position in alignment with the instrument axis. This action is carried out by the selected cartridge acting in concert with the internal body configuration of the writing instrument. Thus, the present invention does not depend on a turret structure or similar arrangement used in prior art devices for holding the cartridges and rotating them into an axially aligned position. The space gained by omitting the aforesaid structure within the restricted volume of the body of the writing instrument is advantageously used in the present invention by providing cartridges having greater ink holding capacity than could be included in heretofore available writing instruments of this type without unduly expanding the external dimensions of such instruments.

Figure 11:
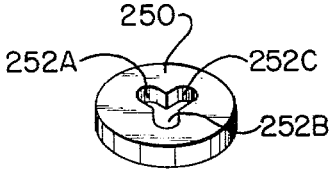
FIG. 11 illustrates an exit template for a 3-element pen.

The preferred embodiment of the invention illustrated and described herein lends itself to various modifications and substitutions. For example coaxial throat section 59 may be thought of as an exit template of generalized circular form, having a maximum interior radius which is 1.5 D, where D is the diameter of lower cartridge section 116. In practice, the radius of the generalized exit template is somewhat larger in order to permit movement of the elements relative to each other.

Where it is important to control the lateral motion of the respective elements precisely, a multi-bay exit template may be used as a throat section, for example a trefoil exit template, such as shown at 250 in FIG. 11. Here, the movement of the three respective elements is constrained by bays 252A, 252B and 252C which permit lateral motion only in a radial direction. The maximum radius of the trefoil is 1.5 D, such that a circle of that radius, i.e. the aforesaid generalized template, encloses all three bays and is tangent thereto.

Where fewer or more than three elements are used, the template is fashioned with a corresponding number of bays. For example, for a 2-element pen the template takes the form of a modified ellipse having parallel sides and a pair of diametrically opposed bays, with the transverse template dimension being substantially equal to D. For a 4-element pen, the template takes substantially the form of a four leaf clover. In each of these arrangements, a radius of 1.5 D determines the circular exit template of generalized form which tangentially surrounds all bays.

Figure 12:
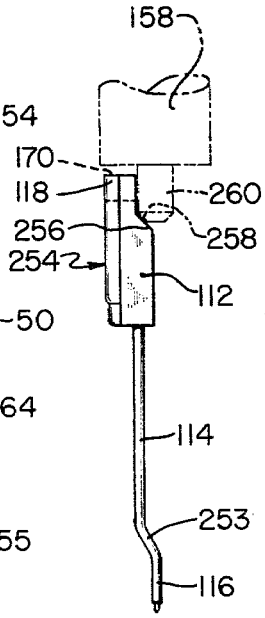
FIG. 12 illustrates another embodiment of a refill cartridge.

Mid-section 114 of the cartridge may be advantageously formed as a continuation of tubular lower section 116, for example in dogleg form as shown in FIG. 12. In this embodiment, the modified writing element 254 includes tubular transition 253, between sections 114 and 116. Tubular transition 253 presents a ramp surface which serves the same function as ramp surface 130 of the cartridge element illustrated in FIG. 10, and which preferably has the same slope. In order to equal the movement of the latter cartridge in the environment of FIG. 1, the cartridge shown in FIG. 12 must be configured so that the axis of section 116 is displaced by one diameter from the axis of section 114. Thus, for the cartridge shown in FIG. 10 as well as in FIG. 12, the joint projection of the cross sections of sections 114 and 116 onto a plane parallel to these cross sections, has a maximum dimension which is twice the diameter of section 116.

As already noted, the invention may operate with identical as well as with dissimilar pen nibs. For example, a single ball point nib may be provided with a number of felt tip nibs, for use with carbons or the like where the pressure exerted by a felt tip nib would be inadequate.

Aside from the constraints imposed by the overall dimensions of the pen, the invention is not limited in the number of elements which may be used, whether of the type shown in FIG. 10 or in FIG. 12. It will be understood that where a sector-shaped upper section 112 is used, the sector angle will change accordingly, e.g. to 180° and 90° for a 2-element and a 4-element pen respectively.

Figure 13:
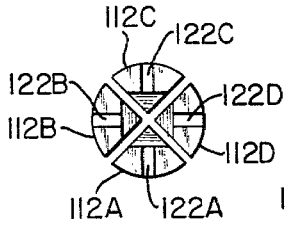
FIG. 13 illustrates the relative positions of refill cartridges of the type shown in FIG. 12 for a 4-element pen.

FIGS. 12 and 13 together illustrate an exemplary 4-element pen, using writing elements 254. The respective elements are shown in their non-selected positions. Upper section 112 of element 254 is seen to be quadrant-shaped in cross section and includes a chamfered surface 256. In order to facilitate the return of these elements to their non-selected positions, pin retaining barrel unit 158 (illustrated in dotted lines in FIG. 12) may be provided with a tapered surface 258, e.g. located on a central extension 260 of unit 158. As the returning element 254 is urged upward in FIG. 12, chamfered surface 256 makes sliding contact with surface 258. The action serves to move the returning element radially outward from its former axial position, to the position shown in FIG. 13.

It should be appreciated that the coupling between cartridge cap 118 of each element 254 with the respective retaining pin 170 is the same and is not shown in detail. For sake of clarity; FIG. 13 shows only slot 122 of the cartridge caps of the writing elements, without the connected pins.

The invention may be further modified with respect to the manner in which pins 170 are positioned in unit 158. For example, where the overall dimensions permit, pin bores 184 may be angled toward the central axis of the pen so that pins 170 will apply a radially inward component of thrust to each selected element in its downward movement.

For particular applications it may be desirable to provide subtractive selection. For example, the elements may be normally in an extended position from which the unwanted element is selected and retracted.

The invention may be modified to provide writing ends at both extremes responsive to a centrally located selection assembly. In essence, such an arrangement duplicates the existing apparatus so that, at each selection station, a pair of elements can be simultaneously selected. Alternatively, the two cams may be displaced with respect to each other so as to select elements in alternation at opposite sides of the instrument upon the rotation of the centrally located selection assembly.

The shape of the cross-section of main shank 100 need not be circular. It may have any form desired consistent with the purpose of the instrument, as dictated by the number of elements employed. For example, for a machine-operated writing instrument, such as a plotter, a non-circular external configuration may be preferable for mounting the writing instrument.

Although the invention has been described in connection with a multi-cartridge pen, it will be apparent that it may find utility in connection with any multi-element device wherein it is desired to select an individual element. For example, the invention may find application in an electrical instrument having a number of probes which are individually selected.

It is also possible to have the selected element extend from the main body in a direction other than axial, e.g. at right angles thereto. This may be accomplished by incorporating a linkage which translates the axial motion of the pins into motion causing the selected element to pivot 90° from its axial position. In such a device the pivoting element portion may need to be positioned around the outside of the main body of the instrument to permit it to execute such motion. Alternatively, the envelope may have the necessary openings to permit such motion.

From the foregoing discussion of the invention, it will be apparent that numerous modifications, variations and substitutions will now occur to those skilled in the art all of which fall within the spirit and scope of the present invention. Accordingly, it is intended that the invention be limited only by the scope of the appended claims.

What is claimed is:

1. A writing apparatus comprising:

an elongated hollow body having an elongated body axis and including (1) an exit opening coaxial with said body axis and disposed at one end of said body, and (2) a writing portion coaxial with said body axis and tapering down to said exit opening, said writing portion including (a) an outer surface substantially continuous with the outer surface of said body and terminating in a coaxial external step normal to said body axis and, (b) a shroud coaxially extending from said step and terminating in said exit opening;

a plurality of elongated writing elements disposed in said body each including a writing point and an opposite end spaced from said point, non-selected ones of said writing elements being uniformly positioned radially around said body axis;

means for successively displacing the writing elements lengthwise along said body such that the displacement is effective to advance the writing point of said selected writing element through said exit opening without contacting the interior of said body and to align the axis of said element with said body axis, said means for successively displacing the writing elements comprising (1) a selection unit coaxially positioned with respect to said body axis and terminating the end of said body opposite said exit opening, said selection unit being rotatable about said axis and including (a) a substantially continuous outer surface, (b) actuating means for displacing each of said elements movable through a succession of selection stations radially positioned about said axis, and (c) a peripheral edge, (2) conversion means for converting the rotary motion of said selection unit into linear displacement, and (3) coupling means coupling each of said opposite ends of said writing elements to said conversion means for selectively transmitting a linear thrust to each of said writing elements while permitting pivotal motion and limited lateral motion thereof;

means for sealing said hollow body; and a substantially cylindrical instrument cap closed at one end and being adapted to be removably mounted alternatively on each of said writing portion and said selection unit, said instrument cap including an outer envelope adapted to make frictional contact at its open end with said cylindrical outer surface of said selection unit, a cap liner secured within said outer envelope and terminating in an internal coaxial shoulder, said internal shoulder being adapted to abut alternatively said external step and said upper peripheral edge in accordance with the position of said instrument cap on said writing portion or on said selection unit respectively;

wherein said internal shoulder of said cap liner and the peripheral edge of said selection unit each includes means for coupling said instrument cap to said selection unit so that said instrument cap is adapted to transmit rotary motion about said body axis to said selection unit when said instrument cap is mounted on said selection unit and said instrument cap is rotated in one direction.

2. Apparatus in accordance with claim 1 wherein said writing portion includes an internal shoulder coaxially narrowing to a hollow cylindrical throat section of substantially uniform cross-sectional diameter;

each of said writing elements comprises a cartridge including relatively positioned upper, middle and lower sections between said opposite end and said writing point having substantially sector-shaped, modified elliptical and circular cross sections respectively, said cartridge sections jointly forming a common linear spine parallel to the axis of said cartridge, the transition between said middle and lower sections forming a transition surface, said lower section having a diameter D, said middle section having maximum and minimum cross-sectional dimensions of substantially 2 D and D respectively; wherein said transition surface of each selected cartridge coacts with said shoulder upon said lengthwise displacement of said cartridge to bring the axis of the writing point of the latter cartridge into alignment with said body axis through substantially lateral movement of said cartridge.

3. Apparatus in accordance with claim 1 wherein said writing portion includes an internal shoulder coaxially narrowing to a hollow cylindrical throat section of substantially uniform cross-sectional diameter;

each of said writing elements comprises a cartridge including relatively positioned upper, middle and lower sections between said opposite end and said writing point, said upper section having a substantially sector-shaped cross section, said middle and lower sections jointly forming a continuous tube having a dogleg configuration and a substantially circular cross section throughout of diameter D, the axes of said middle and lower sections being parallel and displaced from each other a distance D, the transition between said middle and lower sections forming a transition surface;

said transition surface of each selected cartridge coacting with said shoulder upon said lengthwise displacement of said cartridge to bring the writing point of the latter cartridge into alignment with said body axis through substantially lateral movement of said cartridge.

4. Apparatus in accordance with claim 1 wherein said conversion means comprises a solid barrel of generally cylindrical form coaxial with said selection unit and positioned between the latter and said elements, said barrel including a segment of reduced outside diameter at one end thereof;

a plurality of bores extending through said barrel parallel to said body axis, said bores being symmetrically positioned around said body axis at a substantially uniform radial spacing therefrom;

each of said bores including a slot communicating between said bore and the outside of said barrel, each of said slots being substantially coextensive in length with said barrel segment of reduced diameter;

an elongate retaining pin slidably disposed in each of said bores, each of said pins terminating in one of said coupling means coupled to the opposite end of a corresponding element;

a cam follower extending outward from each of said pins through the slot of the corresponding bore; and resilient means for urging each of said pins against said selection unit.

5. Apparatus in accordance with claim 4 wherein said selection unit comprises:

a divider wall normal to said common axis and including a substantially circular impact surface facing said bores, said resilient means urging said pins against said impact surface;

a cam extending from the periphery of said impact surface in the direction of said pins and coaxially surrounding a portion of the periphery of said barrel segment, said cam presenting a cam surface to said cam followers adapted to contact the latter outside said slots, said cam surface being configured to select said pins by successively lifting each of them off said impact surface against the force of said resilient means during a complete revolution of said selection unit in the forward direction relative to said barrel.

6. Apparatus in accordance with claim 5 wherein said divider wall further includes a central opening and a bearing surface parallel to said impact surface;

said bores jointly defining a central shank of said barrel, said shank including a threaded end extending through said central opening; and a torque nut threadly engaging said shank end, said torque nut including a resilient flange urged into contact with said bearing surface to seal said central opening, the torque required to rotate said selection unit in the one direction relative to said barrel being adjustable in accordance with the position of said torque nut on said threaded shank end.

7. Apparatus in accordance with claim 6 wherein said barrel includes a shoulder abutting the upper edge of said body flush with the outer surface thereof;

said selection unit includes a substantially cylindrical recess temrinating in said bearing surface and housing said torque nut therein, the cylindrical wall of said last-recited recess including an external shoulder at its upper edge;

a sleeve positioned between said last-recited shoulder and the shoulder of said barrel to form a substantially continuous cylindrical outer surface with said body; and a cup-shaped top cap covering said torque nut and affixed thereto, said torque nut being peripherally recessed to accept the cylindrical wall of said top cap.

8. Apparatus in accordance with claim 7 wherein said writing portion abuts the lower edge of said body to form a substantially continuous outer surface therewith, said outer surface of said writing portion including a waist of reduced diameter and terminating in a coaxial external step normal to said body axis, said writing portion further including a shroud of reduced diameter coaxially extending from said external step and terminating in said exit opening.

9. Apparatus in accordance with claim 5 wherein said cam surface includes in succession a lift portion sloping with respect to said impact surface, a dwell portion substantially parallel to said impact surface, and a return portion substantially normal to said impact surface;

wherein said dwell portion determines the maximum displacement of the selected pin with respect to said impact surface and said return portion bars rotation of said selection unit in the reverse direction relative to said barrel.

10. Apparatus in accordance with claim 9 wherein said return portion defines an angle with respect to said impact surface approaching but less than 90°.

11. Apparatus in accordance with claim 9 wherein each of said pins comprises a shaft, a cylindrical head of enlarged diameter positioned at one end of said shaft slidably engaging the corresponding bore, said head being integral with said cam follower and including a top surface flush with the latter, a nipple axially extending from said top surface of each pin;

said impact surface including a sector recess straddling the angular position of said cam surface return portion;

a plurality of detent holes in said impact surface each corresponding to a non-selected one of said pins;

said recess and said holes being adapted to move into alignment with said pins during rotation of said selection unit, the width and depth dimensions of said recess and said holes being chosen to admit said nipples while the top surfaces of said pins make contact with said impact surface, said holes being angularly positioned with respect to said dwell portion to receive the nipples of the non-selected pins when the cam follower of said selected pin is on said dwell portion;

whereby a detent action is provided to stabilize the position of said selection unit against further rotation upon selection of each pin.

12. Apparatus in accordance with claim 11 wherein said nipples and said detent holes each have tapered surfaces to facilitate rotational movement of said selection unit out of each detent position, said recess further including a sloped portion at one end thereof enabling each nipple extending into said recess to ride clear thereof when said selection unit is rotated in said one direction.

13. Apparatus in accordance with claim 9 wherein the lower portion of said barrel threadly engages the interior upper portion of said hollow body, and said barrel is capable of disengaging said body by rotation of said selection unit in said reverse direction.

14. Apparatus in accordance with claim 4 wherein each of said bores includes a section of restricted diameter at one end thereof spaced from said barrel segment; and each of said pins comprises:

a shaft slidably extending through said restricted diameter section of the corresponding bore, said shaft terminating in said coupling means outside said bore;

a cylindrical head of enlarged diameter slidably engaging said corresponding bore, said head being positioned at one end of said shaft opposite from said coupling means, said head being integral with said cam follower and including a top surface flush with the latter;

said coupling means including a conical hanger button coaxial with said shaft and having substantially the same diameter as the latter at its widest point, and a neck section of reduced diameter connecting said hanger button to said shaft.

15. Apparatus in accordance with claim 14 wherein said resilient means includes a compression spring surrounding each pin shaft in its corresponding bore between said section of restricted diameter and said cylindrical head.

16. Apparatus in accordance with claim 14 wherein each of said opposite ends of said elements includes a pair of arms defining a substantially C-shaped configuration, the space embraced by said arms accommodating said hanger button of the coupled coupling means, the gap defined between the facing ends of said arms admitting said neck section while excluding said hanger button.

17. Apparatus in accordance with claim 1 wherein each of said writing elements comprises a cartridge including relatively positioned upper, middle and lower sections between said opposite end and said writing point, the transition between said middle and lower sections forming a transition surface, said lower section having a maximum cross section dimension equal to D, said middle and lower sections being positioned relative to each other such that the maximum dimension joint projection of their cross sections on a plane parallel to said cross sections is approximately equal to 2 D;

said writing portion includes an internal shoulder coaxially narrowing to a throat section, said throat section comprising a template having a plurality of bays each corresponding to one of said writing elements, each bay being internally tangent to a circle having a radius of substantially 1.5 D and being adapted to admit the middle section of only one element jointly with the lower sections of the remaining ones of said plurality of elements;

said transition surface of each selected writing element coacting with said shoulder upon said lengthwise displacement of said element to bring the latter into alignment with said body axis through substantially lateral movement of said element.

18. A writing instrument comprising:

an elongate hollow body having a substantially continuous, cylindrical outer surface;

a plurality of elongate writing elements disposed within said body each including a writing point;

a writing portion coaxially positioned with respect to said body and terminating one end thereof, said writing portion forming a substantially continuous outer surface with said body terminating in a coaxial external step normal to said body axis;

a shroud of reduced diameter threadedly engaging the interior of said writing portion and abutting an interior coaxial step of said writing portion, said shroud coaxially extending from said external step and tapering down to an exit opening of reduced diameter concentric with the axis of said body;

a first sealing ring disposed between said interior step and said shroud;

a selection assembly threadedly engaging the interior of said body and terminating the opposite end thereof;

a sleeve coaxially enclosing a portion of said selection assembly extending beyond said body, said sleeve forming a substantially continuous outer surface with said body;

second and third sealing rings positioned between said body and said sleeve respectively and said selection assembly;

said selection assembly comprising means for rotation about said axis through a succession of selection stations to extend the writing point of a separate one of said writing elements through said exit opening at each of said stations, a divider wall closing off said selection assembly, a threaded shank extending through a central bore in said divider wall, an internally threaded torque nut engaging said shank, said torque nut including a resilient peripheral lip bearing against said divider wall so as to seal off said central bore; and a substantially cylindrical instrument cap closed at one end and including an outer envelope, said cap being adapted to be removably mounted on either said writing portion or on said selection assembly such that said outer envelope is in frictional contact with said outer surface, said cap including a cap seal for making sealing contact with said shroud when said cap is mounted on said writing portion.

* * * * *

UNITED STATES PATENT AND TRADEMARK OFFICE

CERTIFICATE OF CORRECTION

PATENT NO. : 4,359,291
DATED : November 16, 1982
INVENTOR(S) : Victor Lum

It is certified that error appears in the above-identified patent and that said Letters Patent are hereby corrected as shown below:

In claim 7, column 16, line 48, the word "temrinating" should be "terminating".

Signed and Sealed this

First Day of February 1983

[SEAL]

*Attest:*

GERALD J. MOSSINGHOFF

*Attesting Officer*

*Commissioner of Patents and Trademarks*